US007556058B2

(12) United States Patent
Chiu

(10) Patent No.: US 7,556,058 B2
(45) Date of Patent: Jul. 7, 2009

(54) ACTIVATION ASSEMBLY IN A DEHUMIDIFIER

(75) Inventor: Ming-Tsung Chiu, Chung-Ho (TW)

(73) Assignee: New Widetech Industries Co., Ltd (TW)

( * ) Notice: Subject to any disclaimer, the term of this patent is extended or adjusted under 35 U.S.C. 154(b) by 756 days.

(21) Appl. No.: 11/359,555

(22) Filed: Feb. 23, 2006

(65) Prior Publication Data

US 2007/0193634 A1 Aug. 23, 2007

(51) Int. Cl.
*F15B 13/00* (2006.01)

(52) U.S. Cl. ..... 137/560; 251/149.6; 200/61.6

(58) Field of Classification Search ..... 137/560; 417/1; 200/51 R, 51.1, 61.6; 251/149.6
See application file for complete search history.

(56) References Cited

U.S. PATENT DOCUMENTS 2,905,485 A * 9/1959 Zajac ..... 251/149.6
4,336,427 A * 6/1982 Lindsay ..... 200/61.6
4,366,945 A * 1/1983 Blauenstein ..... 251/149.6
5,349,146 A * 9/1994 Radabaugh ..... 200/61.6

* cited by examiner

*Primary Examiner*—John Rivell
*Assistant Examiner*—Andrew J Rost
(74) *Attorney, Agent, or Firm*—Hershkovitz & Associates, LLC; Abraham Hershkovitz

(57) ABSTRACT

An activation assembly for activating a pump inside a dehumidifier includes a cover (1) adapted to connect to the dehumidifier and having therein a switch device (11) adapted to electrically connect to the pump. A recoil mechanism (2) is partially extended through the cover (1) and has therein a path (20) to receive a recoil spring (21) compressibly received inside the path (20) and a push (22) movably received inside the path (20) and securely located on top of the recoil spring (21). A clamping element (3) is mounted on top of the recoil mechanism (2). A connector (6) has a tube (61) selectively secured by the clamping element (3) and extending into the recoil mechanism (2). A connector (6) has an extension (62) formed with the tube (61) to contact with the switch device (11) when the tube (61) is extended into the recoil mechanism (2) to complete the communication between the interior of the tube and the path (20) such that the pump is activated by the switch device (11) by the contact of the extension (62) and water is drained by operation of the pump through the path (20) and the interior of the connector (6).

10 Claims, 3 Drawing Sheets

ACTIVATION ASSEMBLY IN A DEHUMIDIFIER

BACKGROUND OF THE INVENTION

1. Field of the Invention

The present invention relates to an activation assembly, and more particularly to an activation assembly in a dehumidifier so that every time the dehumidifier is activated, water is automatically drained out of the dehumidifier.

2. Description of the Prior Art

A conventional dehumidifier normally has a container removably received inside the dehumidifier to receive therein water from the operation of a compressor. After the container is full, the operator has to manually remove the container from the dehumidifier to resume the operation of the dehumidifier or the dehumidifier will automatically shut off due to a safety device mounted inside the dehumidifier. The manual removal of the container once the container is full of water is too time consuming and labor inefficient. Thus an improved dehumidifier is introduced to the market to obviate the aforementioned drawback. The improved dehumidifier has a hole defined therein for connection to a water hose such that the water from the operation of the compressor is able to be directed to the water hose and drained out of the dehumidifier, which does have the advantage to drain the water inside the dehumidifier. However, this kind of dehumidifier is costly because the manufacturer has to develop new molds to adapt to the provision of the water hose so that it is not economic to develop new molds just for the provision of the water hose and not very popular in the market.

To overcome the shortcomings, the present invention tends to provide an improved activation assembly to mitigate the aforementioned problems.

SUMMARY OF THE INVENTION

The primary objective of the present invention is to provide an improved activation assembly to activate the operation of the dehumidifier and start water draining simultaneously.

In one aspect of the present invention, the activation assembly of the present invention includes a cover adapted to be connected to the dehumidifier and having a switch device mounted therein, a recoil mechanism partially extending through the cover and having therein a recoil spring, a clamping element mounted on top of the recoil mechanism and having clamping pins movably mounted on the clamping element, an urging sleeve movably mounted on top of the clamping element and having an inner flange formed on an inner side face of the urging sleeve to engage with the clamping pins so as to control the movement of the clamping pins, a cap movably connected to the cover to control the movement of the urging sleeve and a connector extending through the cap, the urging sleeve, the clamping element and the recoil mechanism to communicate with an interior of the recoil mechanism and having a wedged extension to detachably connected to the switch device such that when the wedged extension is connected to the switch device, the dehumidifier is activated and the operation of a pump inside the dehumidifier is able to drain water to the connector and thus the water is flowing out of the dehumidifier via the connector.

Other objects, advantages and novel features of the invention will become more apparent from the following detailed description when taken in conjunction with the accompanying drawings.

DETAILED DESCRIPTION OF THE PREFERRED EMBODIMENT

Figure 1:
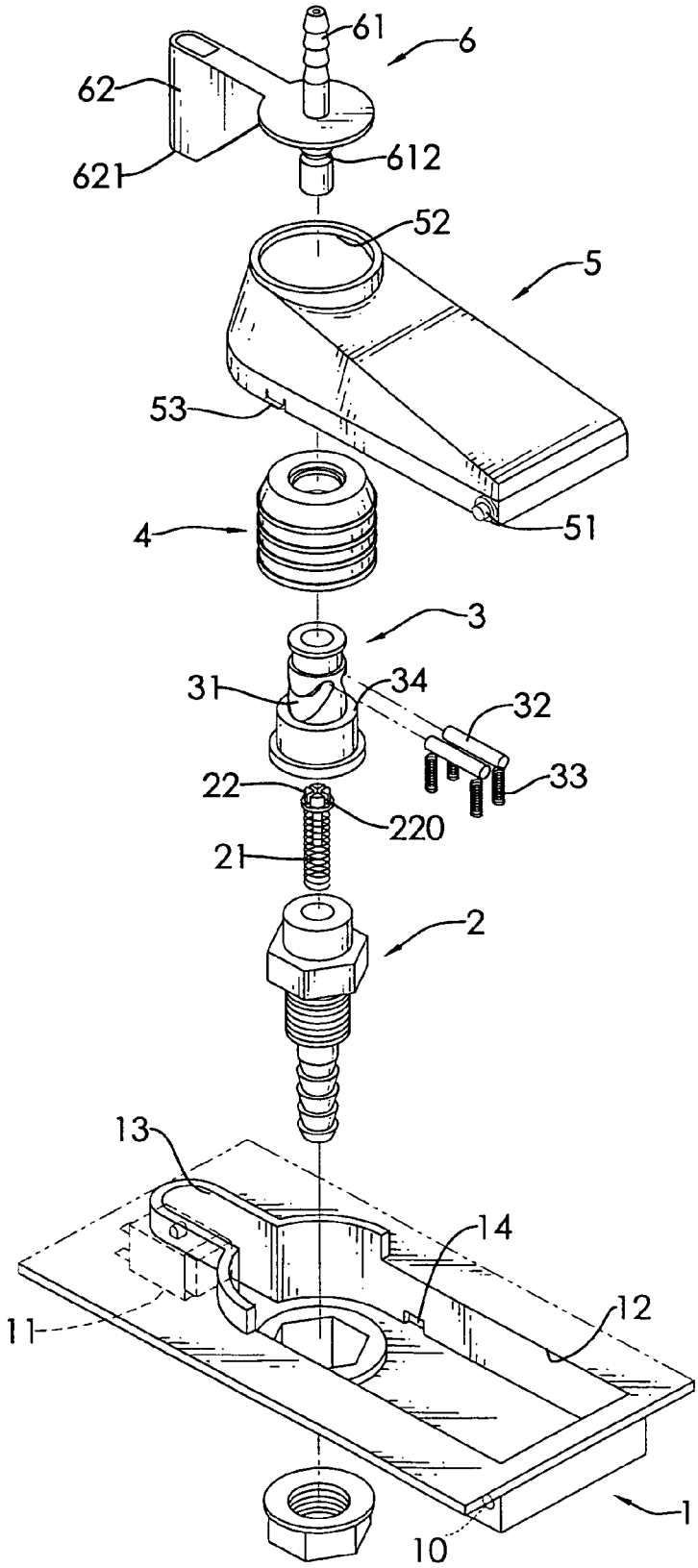
FIG. 1 is an exploded perspective view of the activation assembly of the present invention.
Figure 2:
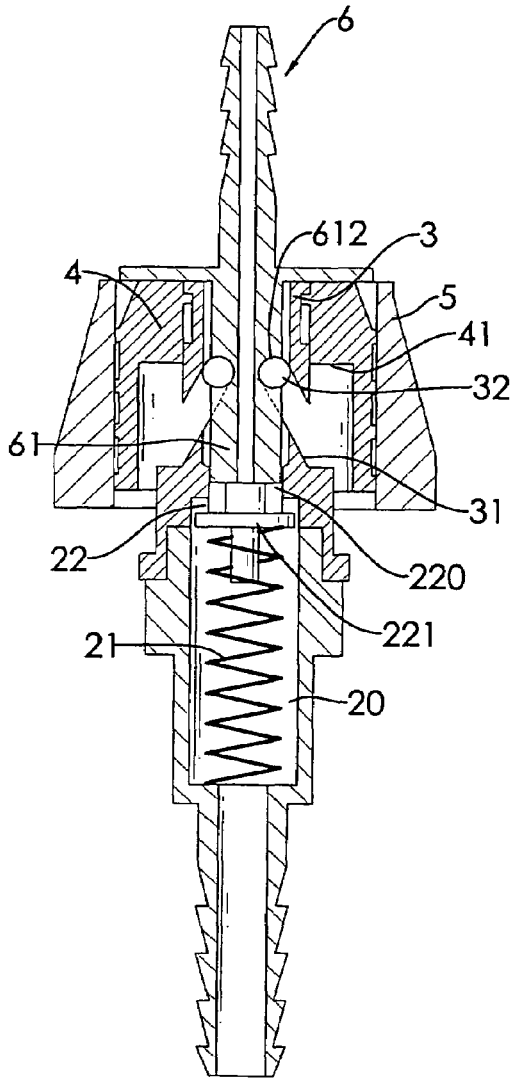
FIG. 2 is a cross sectional view showing the activation assembly after being combined.

With reference to FIGS. 1 and 2, it is noted that the activation assembly in accordance with the present invention includes a cover (1) adapted to be connected to the dehumidifier (not shown) and having a switch device (11) mounted therein, a recoil mechanism (2) partially extending through the cover (1) and having therein a recoil spring (21), a clamping element (3) mounted on top of the recoil mechanism (2) and having clamping pins (32) movably mounted on the clamping element (3), an urging sleeve (4) movably mounted on top of the clamping element (3) and having an inner step (41) formed on an inner side face of the urging sleeve to engage with the clamping pins (32) so as to control the movement of the clamping pins (32), a cap (5) movably connected to the cover to control the movement of the urging sleeve (4) and a connector (6) extending through the cap (5), the urging sleeve (4), the clamping element (3) and the recoil mechanism (2) to communicate with an interior of the recoil mechanism (2) and having a wedged extension (621) to detachably connected to the switch device (11) such that when the wedged extension (621) is connected to the switch device (11), the dehumidifier is activated and the operation of the compressor inside the dehumidifier is able to drain water to the connector (6) and thus the water is flowing out of the dehumidifier via the connector.

The cover (1) is provided with a recess (12) and a Y-shaped recess (13) in communication with the recess (12). The switch device (11) is mounted on a bottom face defining the Y-shaped recess (13). A pivot hole (10) is defined in two opposite side face defining the recess (12) and a positioning hole (14) is defined at a joint between the side face and the bottom face defining the recess (12). A through hole (not numbered) is defined through the bottom face defining the recess (12).

The recoil mechanism (2) is configured in such a way that after the recoil mechanism (2) is partially extended through the through hole of the cover (1), there is no relative movement between the recoil mechanism (2) and the cover (1). In this embodiment, the recoil mechanism (2) is provided with an outer threading formed on an outer periphery thereof so that after the recoil mechanism (2) is extended through the through hole of the cover (1), a nut is able to threadingly connect to and position the recoil mechanism (2). With reference to FIG. 2, it is noted that the recoil mechanism (2) has a path (20) defined therein and two openings in communication with the path (20). Inside the recoil mechanism (2), there is provided with a recoil spring (21) a distal end thereof is abutted against a bottom face defining a bottom opening of the recoil mechanism and a proximal end thereof is securely connected to a push (22) which is abutted against a top face defining a top opening of the recoil mechanism. The push (22) has a sealing rim (221) formed on a bottom thereof and multiple cutouts (220) defined in the push (22) and communicating with each other.

The clamping element (3) is provided with a passage (not numbered) in communication with a top opening and a bottom opening thereof. A top portion of the recoil mechanism (2) is able to be received in the bottom opening of the clamping element (3). The clamping element (3) further has two opposite arcuate slots (31) to respectively receive therein a clamping pin (32) and a spring (33) and a shoulder (34) formed at a bottom of each of the arcuate slots (31) such that after the two clamping pins (32) are received in the two arcuate slots (31), the two springs (33) are able to be sandwiched between the corresponding clamping pins (32) and the shoulder (34).

The urging sleeve (4) has two openings to communicate with an interior of the urging sleeve (4) and the step (41) is formed on an inner side face of the urging sleeve (4). The cap (5) has two pivots (51) each formed on a side face thereof to be opposite to each other to correspond to the pivot hole (10) of the cover (1), an extension hole (52) defined through the cap (5) and two positioning rods (53) formed on a mediate portion thereof to be opposite to each other. Each positioning rod (53) corresponds to one of the positioning holes (14) of the cover (1). Because the dimension of the positioning hole (14) is larger than that of the positioning rod (53), after the pivots (51) are inserted into the corresponding pivot holes (10) and the positioning rods (53) are inserted into the positioning holes (14), the cap (5) is able to move within a limited range.

The connector (6) has a tube (61) and an extension (62) formed on a side of the tube (61) and provided with a wedged extension (621) formed on a bottom portion of the extension (62) to correspond to the switch device (11) in the cover (1). The tube (61) has a hole (611) defined therein to communicate with the path (20) of the recoil mechanism (2). The connector (6) further has an annular recess (612) defined in an outer periphery of the tube (61) to correspond to and receive therein a portion of the two clamping pins (32).

When the activation assembly of the present invention is assembled, it is noted that the recoil mechanism (2) is partially extended through the cover (1) and secured by the nut. After the clamping element (3) is mounted on top of the recoil mechanism (2) and the urging sleeve (4) is mounted on top of the clamping element (3), it is to be noted that the step (41) is in constant contact with the two clamping pins (32) which are urged by the two corresponding springs (33). Then the cap (5) is mounted on the cover (1) to have the pivots (51) inserted into the pivot holes (10) and the positioning rods (53) inserted into the positioning holes (14). Thereafter, due to the recoil force from the two springs (33) by the downward movement of the cap (5), the cap (5) is able to move within a limited range. Then after the tube (61) of the connector (6) is extended through the extension hole (52) of the cap (5), the urging sleeve (4), the clamping element (3) and the recoil mechanism (2) to allow the hole (612) to communicate with the path (20) of the recoil mechanism (2), the two clamping pins (32) are securely received in the annular recess (612) to position the connector (6) on top of the cap (5). Furthermore, after the extension of the connector (6) into the cap (5), the push (22) is connected to the distal end of the tube (61) so that the push (22) is pushed away from the top opening of the path (20) by the distal end of the tube (61). Because of the movement of the push (22), the sealing rim (221) originally functioned as a plug to the top opening of the path (20) is thus moving away from the top opening of the path (20) such that the path (20) is now in communication with the hole (611).

Figure 3:
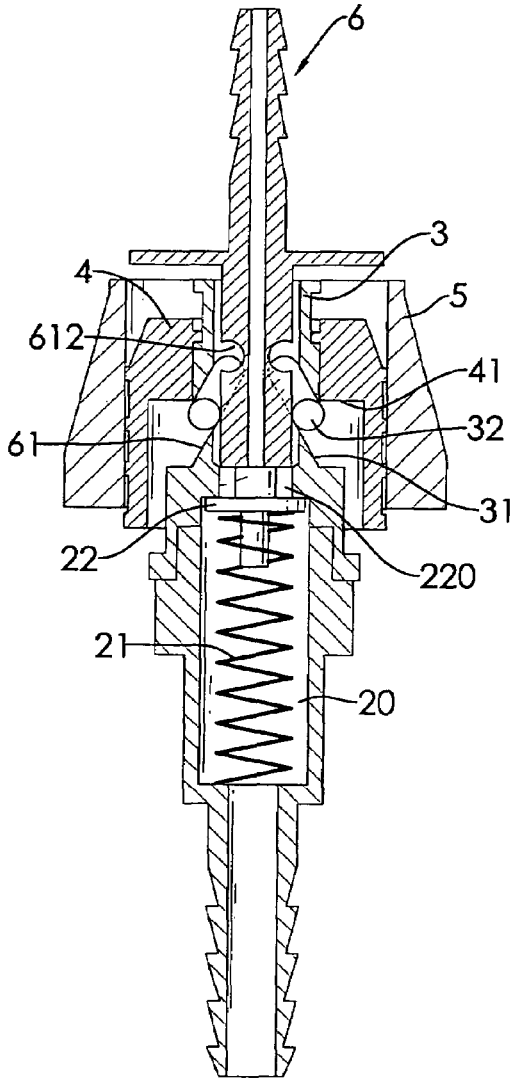
FIG. 3 is an operational cross-sectioned view showing the detachment of the connector from the clamping element.

Again, after the connector (6) is positioned on top of the cap (5), the wedged extension (621) is able to engage with the switch device (11) in the Y-shaped recess (13), which activates the compressor inside the dehumidifier to start working and a pump inside the dehumidifier is also activated to start draining water. Therefore, it is convenient that activation of the dehumidifier and the pump can be accomplished simultaneously by the extension of the connector (6). With reference to FIG. 3, when the operation of the dehumidifier is no longer required, the user presses the cap (5) downward to force the urging sleeve (4) to move as well downward. Due to the step (41) of the urging sleeve (4) being in constant contact to the clamping pins (32), the downward movement of the urging sleeve (4) forces the two clamping pins (320 to move downward along the two arcuate slots (31). Therefore, the two clamping pins (32) are away from the annular recess (612) of he connector (6). After the two clamping pins (32) are moved away from the annular recess (612) of the connector (6), the recoil force from the compressed recoil spring (21) pushes the distal end of the tube (61) to eject the connector (6) out of the recoil mechanism (2), which terminates the contact from the wedged extension (621) to the switch device (11). Thus the pump inside the dehumidifier stops operation automatically.

Figure 4:
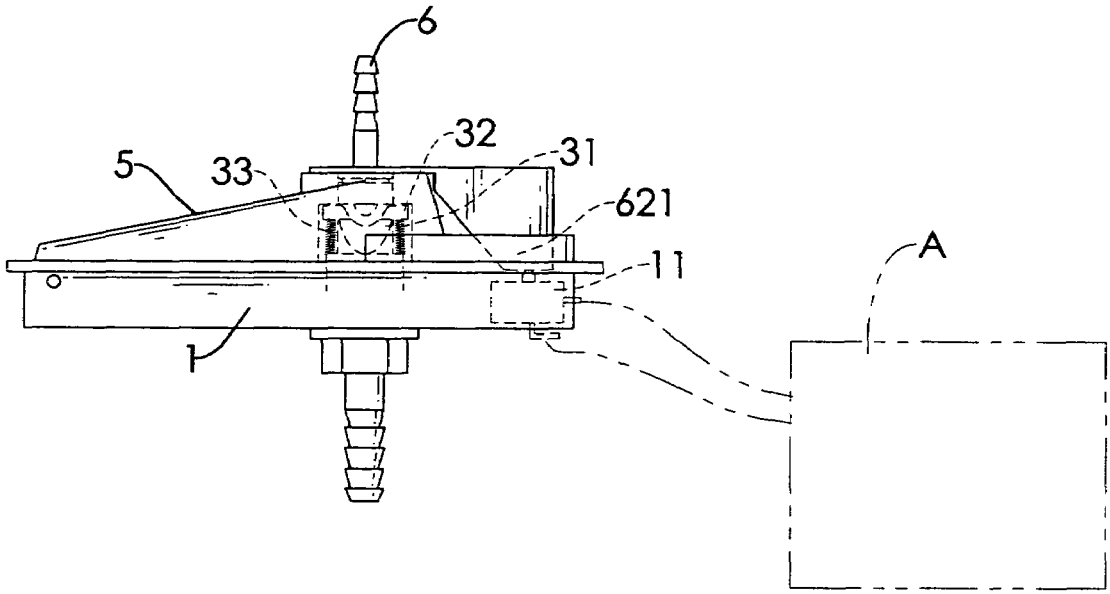
FIG. 4 is a schematic side plan view showing that the movement of the connector allows the wedged extension to engage with the switch device, which activates the compressor inside dehumidifier.

With reference to FIG. 4, it is noted that when the connector (6) is extended into the cap (5) to connect to the recoil mechanism (2), the wedged extension (621) of the connector (6) is engaged with the switch device (11) to activate the pump (A) which is electrically connected to the switch device (11).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An activation assembly for activating a pump inside a dehumidifier, the activation assembly comprising:

a cover (1) adapted to connect to the dehumidifier and having therein a switch device (11) adapted to electrically connect to the pump;

a recoil mechanism (2) partially extended through the cover (1) and having therein a path (20) to receive a recoil spring (21) compressibly received inside the path (20) and a push (22) movably received inside the path (20) and securely located on top of the recoil spring (21), the push (22) having a sealing rim (221) formed at a bottom of the push (22) to plug a top opening of the path (20);

a clamping element (3) mounted on top of the recoil mechanism (2);

a connector (6) having a tube (61) selectively secured by the clamping element (3) and extending into the recoil mechanism (2) to push the sealing rim (221) of the push (22) away from the top opening of the path (20) to allow communication between an interior of the tube (61) and the path (20), the connector (6) having an extension (62) formed with the tube (61) to contact with the switch device (11) when the tube (61) is extended into the recoil mechanism (2) to complete the communication between the interior of the tube and the path (20) such that the pump is activated by the switch device (11) by the contact of the extension (62) and water is drained by operation of the pump through the path (20) and the interior of the connector (6).

2. The activation assembly as claimed in claim 1, wherein the tube (61) has a hole (611) defined therein to communicate with the path (20) of the recoil mechanism (2) so that water is flowing through the path (20) and the hole (611) of the connector (6).

3. The activation assembly as claimed in claim 2, wherein the push (22) has multiple cutouts (220) defined in the push (22) so that water is flowing through the cutouts (220) and into the hole (611) of the connector (6) from a bottom opening of the recoil mechanism (2).

4. The activation assembly as claimed in claim 3, wherein the tube (61) has an annular recess (612) defined in an outer periphery thereof and the clamping element (3) has two clamping pins (32) movably received therein to be selectively received in the annular recess (612) so as to secure position of the tube (61) after extension into the recoil mechanism (2).

5. The activation assembly as claimed in claim 4, wherein the clamping element (3) further comprises two arcuate slots (31) oppositely defined in the clamping element (3) to receive therein the two clamping pins (32) and two springs (33) respectively sandwiched between a corresponding one of the two clamping pins (32) and a shoulder (34) formed on an outer periphery of the clamping element (3).

6. The activation assembly as claimed in claim 5 further comprising an urging sleeve (4) mounted on top of the clamping element (3) and having a step (41) formed on an inner side face thereof to be in constant contact with the two clamping pins (32) such that downward movement of the urging sleeve (4) moves the two clamping pins (32) away from the annular recess (612) so as to free the tube (61) of the connector (6).

7. The activation assembly as claimed in claim 6 further comprising a cap (5) pivotally connected to the cover and mounted on top of the urging sleeve (4) such that downward pivotal movement of the cap (5) drives the urging sleeve (4) as well as the clamping pins (32) to move downward to allow the two clamping pins (32) to leave the annular recess (612) of the tube of the connector (6) and to allow the recoil spring (21) to push the connector (6) out of the recoil mechanism (2).

8. The activation assembly as claimed in claim 3, wherein the clamping element (3) further comprises two arcuate slots (31) oppositely defined in the clamping element (3) to receive therein the two clamping pins (32) and two springs (33) respectively sandwiched between a corresponding one of the two clamping pins (32) and a shoulder (34) formed on an outer periphery of the clamping element (3).

9. The activation assembly as claimed in claim 2, wherein the tube (61) has an annular recess (612) defined in an outer periphery thereof and the clamping element (3) has two clamping pins (32) movably received therein to be selectively received in the annular recess (612) so as to secure position of the tube (61) after extension into the recoil mechanism (2).

10. The activation assembly as claimed in claim 9, wherein the clamping element (3) further comprises two arcuate slots (31) oppositely defined in the clamping element (3) to receive therein the two clamping pins (32) and two springs (33) respectively sandwiched between a corresponding one of the two clamping pins (32) and a shoulder (34) formed on an outer periphery of the clamping element (3).

* * * * *